US009476587B2

(12) United States Patent
Bettinzoli

(10) Patent No.: US 9,476,587 B2
(45) Date of Patent: Oct. 25, 2016

(54) GAS BURNER FOR OVENS OR GRILLS

(75) Inventor: Angelo Bettinzoli, Concesio (IT)

(73) Assignee: SABAF S.P.A., Ospitaletto (BS) (IT)

( * ) Notice: Subject to any disclaimer, the term of this patent is extended or adjusted under 35 U.S.C. 154(b) by 1265 days.

(21) Appl. No.: 12/993,042

(22) PCT Filed: Jun. 23, 2008

(86) PCT No.: PCT/IT2008/000422

§ 371 (c)(1),
(2), (4) Date: Nov. 16, 2010

(87) PCT Pub. No.: WO2009/157021

PCT Pub. Date: Dec. 30, 2009

(65) Prior Publication Data

US 2011/0067686 A1 Mar. 24, 2011

(51) Int. Cl.

| | |
|---|---|
| ***F24C 3/00*** | (2006.01) |
| ***F23Q 3/00*** | (2006.01) |
| ***F23D 14/62*** | (2006.01) |
| ***F23D 14/10*** | (2006.01) |
| ***F24C 3/10*** | (2006.01) |
| ***F23D 14/08*** | (2006.01) |
| ***F23Q 9/04*** | (2006.01) |

(52) U.S. Cl.

CPC ..... *F23D 14/105* (2013.01); *F23D 14/085* (2013.01); *F23D 14/10* (2013.01); *F23Q 9/045* (2013.01); *F24C 3/10* (2013.01); *F23D 2207/00* (2013.01); *F23D 2208/10* (2013.01)

(58) Field of Classification Search

CPC ..... F24C 3/10; F23D 14/10; F23D 14/085; F23D 14/105; F23D 2207/00; F23D 2208/10; F23Q 9/045

USPC ..... 126/39 E; 431/264, 354

See application file for complete search history.

(56) References Cited

U.S. PATENT DOCUMENTS

| | | | | |
|---|---|---|---|---|
| 1,539,324 | A * | 5/1925 | O'Dowd | F23Q 9/045 431/249 |
| 1,625,623 | A * | 4/1927 | O'Dowd | 126/39 E |
| 3,028,909 | A * | 4/1962 | Faure | 431/53 |
| 4,457,293 | A * | 7/1984 | Berlik | F24C 15/2042 126/214 R |
| 4,557,293 | A * | 12/1985 | Guens et al. | 137/625.65 |
| 5,213,075 | A * | 5/1993 | Stephen | F23Q 13/02 126/25 B |

(Continued)

FOREIGN PATENT DOCUMENTS

| | | |
|---|---|---|
| FR | 736842 A | 11/1932 |
| WO | 2004/005799 A | 1/2004 |

*Primary Examiner* — William G Corboy
(74) *Attorney, Agent, or Firm* — Lucas & Mercanti, LLP

(57) ABSTRACT

Gas burner for oven, or grill, of the type comprising at least one Venturi tube (16), for forming the fuel mixture of primary air-gas, having at least one zone with a reduced section followed by a zone with a diverging section, at least one distribution chamber (17) of the fuel mixture, placed downstream the zone with a diverging section of the Venturi tube (16), and a plurality of flame openings (19) for the outflow of the fuel mixture, obtained within such a distribution chamber (17), or in fluidic communication with the latter, as well at least one ignition hole (13) for igniting the burner. Advantageously the latter comprises at least one diversion duct (12) for part of the flow of the fuel mixture, exhibiting its own inlet section obtained in a sector downstream the zone with a reduced section of the Venturi tube (16), and its own outlet section placed at the afore said ignition hole (13).

19 Claims, 4 Drawing Sheets

(56) References Cited

U.S. PATENT DOCUMENTS

2005/0098169 A1* 5/2005 Frederiksen ..... F24C 3/128
126/41 R
2005/0138789 A1* 6/2005 Offredi ..... F23D 14/105
29/505
2006/0003277 A1* 1/2006 Jeng ..... 431/263
2009/0205631 A1* 8/2009 Tsung ..... 126/39 E

* cited by examiner

GAS BURNER FOR OVENS OR GRILLS

CROSS-REFERENCE TO RELATED APPLICATION

This application is a 371 of PCT/IT2008/000422 filed Jun. 23, 2008, the contents of which are incorporated herein by reference.

FIELD OF THE INVENTION

The present invention refers to a gas burner of the elongated type, to be used in oven or grill, comprising a mixing chamber, composed of a Venturi tube, adapted to create a mixture of gas-primary air, and an elongated chamber, situated downstream the Venturi tube, provided with a plurality of holes for such a fuel mixture outflow and the corresponding combustion.

KNOWN PREVIOUS ART

In this type of burner, the mixture of primary air-fuel gas is first made carrying the inlet gas flow through a mixing chamber, composed of a Venturi tube open to the surrounding air, then it is introduced into an elongated main chamber, and successively it is burnt after its outflow through the holes, or openings, obtained in such an elongated main chamber, and conveniently shaped for the optimal flame generating after such a mixture ignition.

The mixture ignition is commonly controlled by the user by means of an proper device comprising an ignition spark plug electrically operated, disposed to spark the flame next to at least one ignition hole having generally reduced dimensions relative to the other flame openings that are present on the burner, and being placed downstream the Venturi tube in a section wherein the fuel mixture is already produced. In its turn the initial flame sparks the ignition of the flame holes placed in its immediate vicinity and, consequently, of all those being present on the burner, sometimes thanks to some appropriate flame propagating means too, such as ducts, grooves, or others, functionally joining the ignition hole to the flame holes and/or these latter one to each other.

Then the ignition hole, in addition to having to be placed in a burner section wherein the mixture has been already produced, it has to be realized in proximity of the flame holes, or the afore said flame propagating means, so close to cause the ignition thereof.

In proximity of such an ignition hole a thermocouple might be placed as well, belonging to a safety device against the accidental burner switching off, known by itself, that is disposed to detect the flame presence at the afore said ignition hole.

Problems inherent in the ignition hole position on the burner body can be detected in the constructive need of arranging the ignition spark plug, and eventually the thermocouple, in proximity thereof, and particularly in providing the intruding installation of such an ignition spark plug, and of such a thermocouple, within the oven cavity, such that it will seem accurately disposed at the ignition hole obtained on the burner body.

Burners are known of the type wherein the ignition spark plug, inside the oven chamber, is held in a position next to the ignition hole, disposed over the burner body according to the afore described method, by brackets, or supports, conveniently elongated.

For example, in the International Patent Application WO 2004/005799, in the name of CAST srl, it is described such a bracket disposed to hold inside the oven, at a considerable distance from the walls of the latter, not only the burner ignition spark plug, but the detecting device for the flame (thermocouple) too, adapted to stop the gas flow in case of accidental switches off of the flame.

This constructive solution determines a number of drawbacks inherent in the overheating ignition spark plug, situated in proximity of the burner body, and the bracket used for mounting.

Particularly, the latter, generally realized in metallic material, when subjected to heat for long time exposures, will necessarily suffer some deformations, inducing the removal, or anyway the moving, of the ignition spark plug from the reliable position in proximity of the ignition hole.

The deformations of the mounting support, above described, combined with the ignition spark plug overheating, would determine difficulties in possible hot re-ignition of the burner, forcing the user to multiple attempts.

Similar observations can be made for electric connecting wirings of the ignition spark plug and eventually of a safety thermocouple, the latter being fitted in the oven cavity too in proximity of the main chamber of the burner, in which the flame holes are realized. Such wirings must be conveniently insulated, with the consequent realization difficulties, in the length in which these are extending into the oven cavity.

It is an object of the present invention to realize an oven or grill burner, of the type above mentioned, that would not present the drawbacks of the known prior art.

Particularly it is an object of the present invention to realize an oven or grill burner allowing to freely dispose the ignition spark plug into the oven cavity, in proximity of a wall of the latter too, while assuring the effective ignition of the burner and the correct arrangement of the safety thermocouple.

It is another object of the present invention to realize an oven provided with at least one burner of the above mentioned type that would be easy to realize and allowing high flexibility in the arrangement of the ignition spark plug and the safety thermocouple of the afore said burner.

SUMMARY OF THE INVENTION

These and other objects are obtained by the burner according to the first independent claim and the subsequent dependent claims and by the oven according to the twelfth claim and the subsequent claims dependent thereto.

The gas burner for oven, or grill, according to the present invention, comprises at least one Venturi tube, for forming the fuel mixture of primary air-gas, of the type having at least one zone with a reduced section followed by a zone with a diverging section, at least one preferably elongated distribution chamber, for distributing the fuel mixture, placed downstream the afore said zone with a diverging section of the Venturi tube, and a plurality of flame openings for the outflow of the fuel mixture, obtained within the distribution chamber, or anyway in fluidic communication with the latter, as well at least one ignition hole for igniting the burner. Advantageously, the burner comprises as well at least one diversion duct for part of the flow of the mixture, having the inlet section obtained in a sector downstream the zone with a reduced section of the Venturi tube, and the outlet section placed at the afore said ignition hole.

The diversion duct having the ignition hole at the end, object of the invention, starts downstream the Venturi tube, or at least downstream its zone with reduced section, and might end in any position inside the oven, preferably on the burner body, resulting convenient to the purposes of the burner ignition spark plug arrangement, in the oven itself.

Thereby such a solution confers high arrangement flexibility of the ignition spark plug, and eventually of the thermocouple, the burner, inside the cavity of the oven, or grill.

According to a preferred aspect of the present invention, the afore said inlet section of the diversion duct is composed of an opening obtained on an inner wall of the Venturi tube or the distribution chamber of the burner.

According to another preferred aspect of the present invention, the burner is constrained to the corresponding oven, or grill, at, or in proximity of, at least one oven or grill wall, and the ignition hole, coincident as mentioned with the outlet section of the afore said diversion duct, is disposed on the burner in proximity of, or at such an oven or grill wall.

Conveniently, it is possible to dispose such a diversion duct end coincidentally with the burner ignition hole in proximity of an oven wall, for example in proximity of the wall which the burner is coupled to, so that the ignition spark plug, and eventually the safety thermocouple too, might be held at such an oven wall, in proper holes obtained in the latter, and then could protrude into the oven cavity for a short length only, without the need of utilizing elongated brackets and high insulation of the corresponding wirings.

In this case, the ignition of the flame holes, as the ignition hole could be moved in proximity of the oven wall at some distance from the flame holes themselves, might be assured by a beneath opening, adapted to propagate the mixture from the ignition hole to the flame holes placed downstream the Venturi tube, or by other means, known in the art, for propagating the flame. By doing so, at the same time, the above mentioned requirements inherent with the ignition hole are satisfied, that is to be fed with a fuel mixture (gas-primary air) already formed and to allow the inter-ignition of the flame holes, and then upon resolution of the problems relative to the overheating and possible deformation of the metallic mounting brackets of the ignition spark plug and the safety thermocouple, and the corresponding wirings.

It has moreover to be noticed the extreme positioning freedom of the ignition spark plug, and eventually of the thermocouple, into the oven cavity, that the present invention entails, allowing, for example, to constrain the ignition spark plug and the possible burner thermocouple in places easily reachable from the outside of the oven, so that their possible replacement for maintenance will result extremely eased.

According to a preferred aspect of the present invention, it is further provided an oven, or grill, comprising means for coupling a gas burner according to the present invention, directly or indirectly, to a wall of the oven or grill itself, as well at least one ignition spark plug for the afore said gas burner, wherein the ignition spark plug is constrained in proximity of, or at the afore said oven or grill wall, and preferably it is directly constrained thereto, or at least only partially protruding therefrom.

BRIEF DESCRIPTION OF THE DRAWINGS

For purposes of illustrations and not limitative, an embodiment of the present invention will be described with reference to the accompanying figures, in which.

DETAILED DESCRIPTION OF A PREFERRED EMBODIMENT OF THE PRESENT INVENTION

Figure 1:
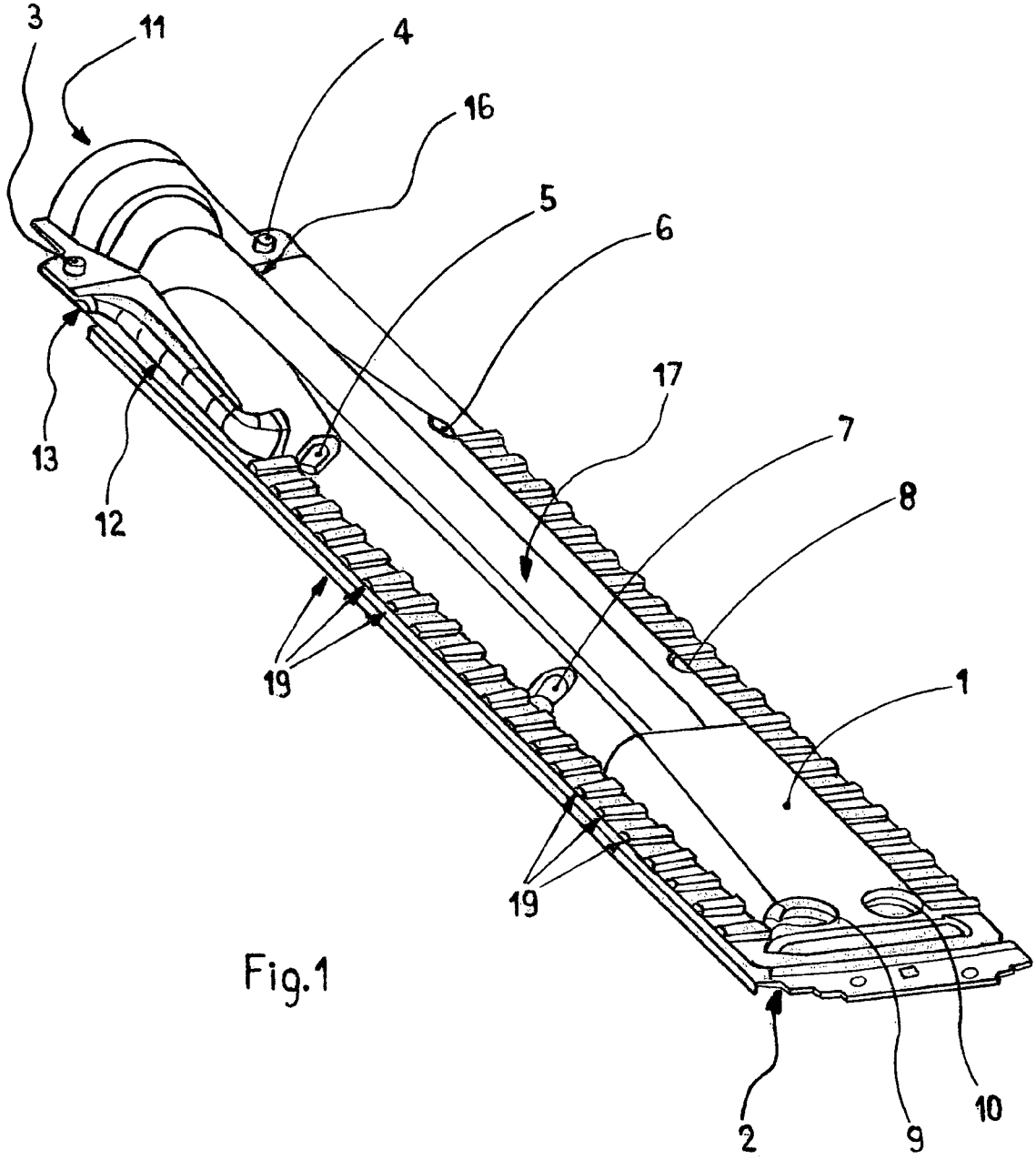
FIG. 1 is a prospective view of the burner.

Firstly referring to FIG. 1, the gas burner object of the present invention, in its preferred embodiment herein explained, comprises an upper metallic semi-shell 1, a lower metallic semi-shell 2, and preferably an intermediate pierced plate 14, all preferably shaped by moulding, such that to define in their inside, once coupled, a Venturi tube 16 for mixing the fuel gas with air (primary air) drawn from the outside of the burner, and at least one elongated chamber 17, coaxial to the Venturi tube 16, for distributing the fuel mixture of gas-primary air to a plurality of flame openings 19, directly realized along the side walls of the elongated chamber 17, or anyway fluidically connected to such a distribution chamber 17.

The two semi-shells 1, 2 might be mutually coupled, preferably, as will be mentioned, with the interposition of a pierced plate 14, by known clamping elements 3, 4, 5, 6, 7, 8, 9, 10, for example of the screw and nut screw type, situated in various places of the longitudinal development of the gas burner.

The Venturi tube 16, as visible in figure, is of the converging-diverging type with an axial development, that is of the type comprising an inlet section 11, intended to be coupled to an ejection nozzle (or injector) 23 of the fuel gas, followed by a zone having a section converging towards a central zone with a reduced section, beyond which such a Venturi tube 16 widens into a diverging section zone for the mixture outlet, and wherein any of the converging section zone, the reduced section zone, and the diverging section zone present an axial symmetry relative to the same longitudinal axis.

It has to be noticed that, although it is herein illustrated a Venturi tube 16 with a converging-diverging section, of the axial type, any other type of Venturi tube, composed of at least one reduced section zone, followed by a zone with a gradually diverging section, could be likewise used in the burner herein claimed, without therefore falling out from the protection scope claimed in the following claims.

It has further to be noticed that any other type of gas burner, not necessarily made of two semi-shells 1, 2 and the intermediate pierced plate 14, provided that it has a Venturi tube followed by a distribution chamber for the fuel mixture, falls in the inventive object of the present patent right.

Advantageously, the herein illustrated burner further comprises a diversion duct 12 for some of the fuel mixture flow, preferably obtained by moulding in at least one of the semi-shells 1 or 2 and eventually in such an intermediate plate 14, having its own inlet mixture section situated downstream the zone having a reduced section of the Venturi tube 16, in fluidic communication with the latter, and its own outlet section, outside the burner, coincident with one or more ignition holes 13 to ignite such a fuel mixture.

More in detail, the herein illustrated burner provides only one ignition hole 13, exclusively coincident with the outlet section of the diversion duct 12, and means for propagating flame from the ignition hole 13 to the flame openings 19, composed of, as will be detailed, a longitudinal calibrated passageway 20 that substantially surrounds at the bottom such a flame apertures 19, adapted to allow the outflow of the mixture in reduced extent outwardly.

The herein described burner has not any other ignition holes except the hole 13 and allows to dispose the latter in any position along the burner body, for example in a position coincident with the location, within the oven or grill, wherein it is more appropriate to dispose the ignition spark plug, and eventually the thermocouple of the safety device, of the burner itself.

It has to be observed that, although herein it is illustrated a burner provided with a diversion duct 12 obtained by moulding of the burner body itself, any other type of diversion duct, externally to the burner too, and then applied thereon, falls in the same inventive conception of the present invention.

That is, the present invention does not exclude the possibility of realizing diversion ducts 12 eventually outside the burner main body, adapted to move the ignition hole 13 towards another oven wall wherein the ignition spark plug has been conveniently housed, or towards any other position believed optimal, preferably, but not exclusively, on the burner body itself.

It has to be noticed that, thanks to the particular shape of the burner above described, the carrying out of the diversion duct 12 elongated along the burner in a way coincident with the fuel mixture inlet way into the burner (that is with a flow carried by the duct 12 cocurrently, from the left to the right in FIG. 1) or in a way opposing to the fuel mixture way in the burner (as in case of FIG. 1, with the mixture flow in the duct 12 countercurrently relative to the mixture flow in the distribution chamber 17) is part of the protection scope herein claimed.

It has to be further observed that, advantageously, the inlet section of the diversion duct 12 is an opening obtained in an inner wall of the ending portion of the afore said zone with a diverging section of the Venturi tube 16 or, downstream the latter, in an inner wall of the distribution chamber 17.

Figure 2:
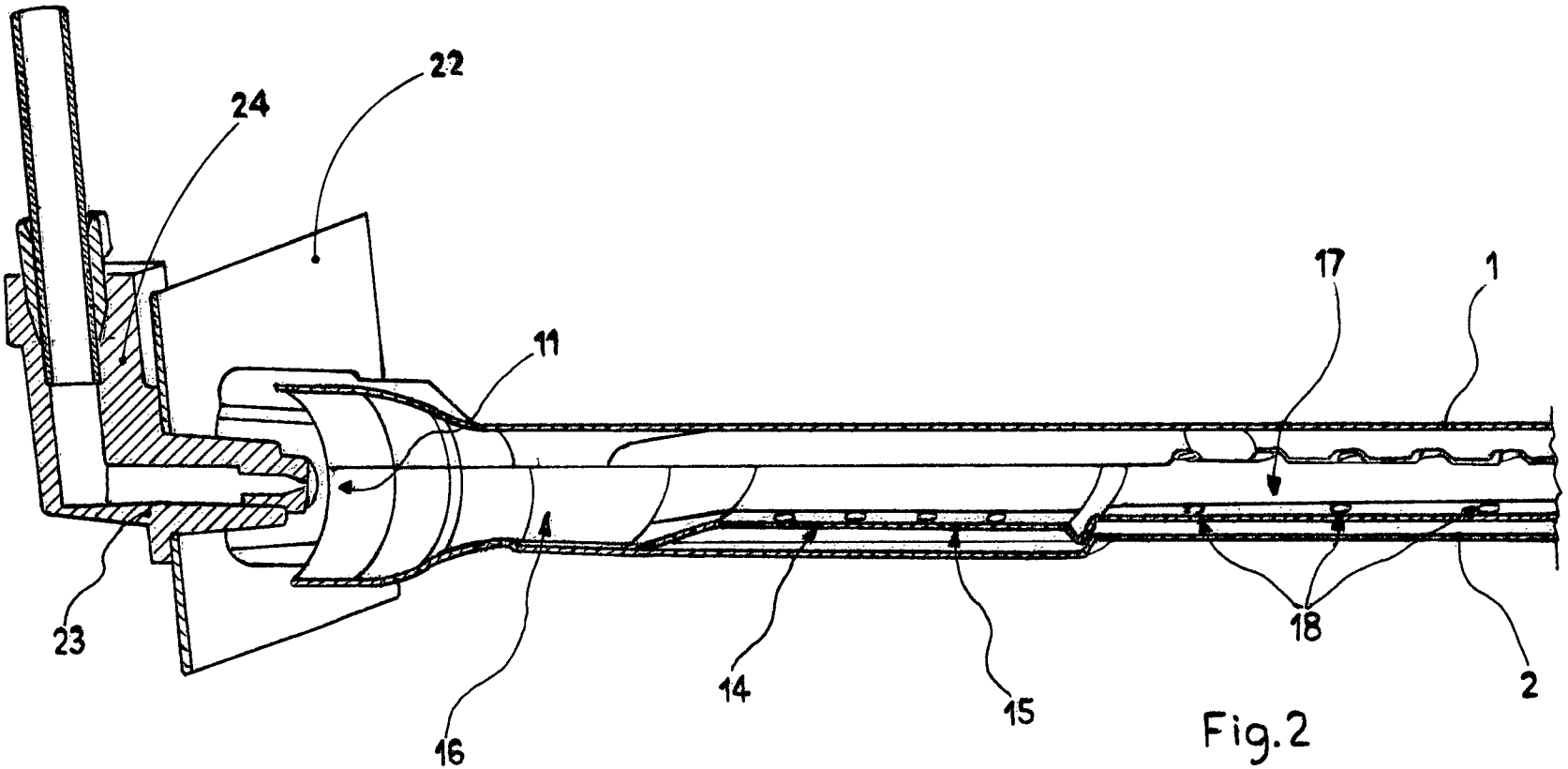
FIG. 2 is a longitudinal section view of the burner.
Figure 3:
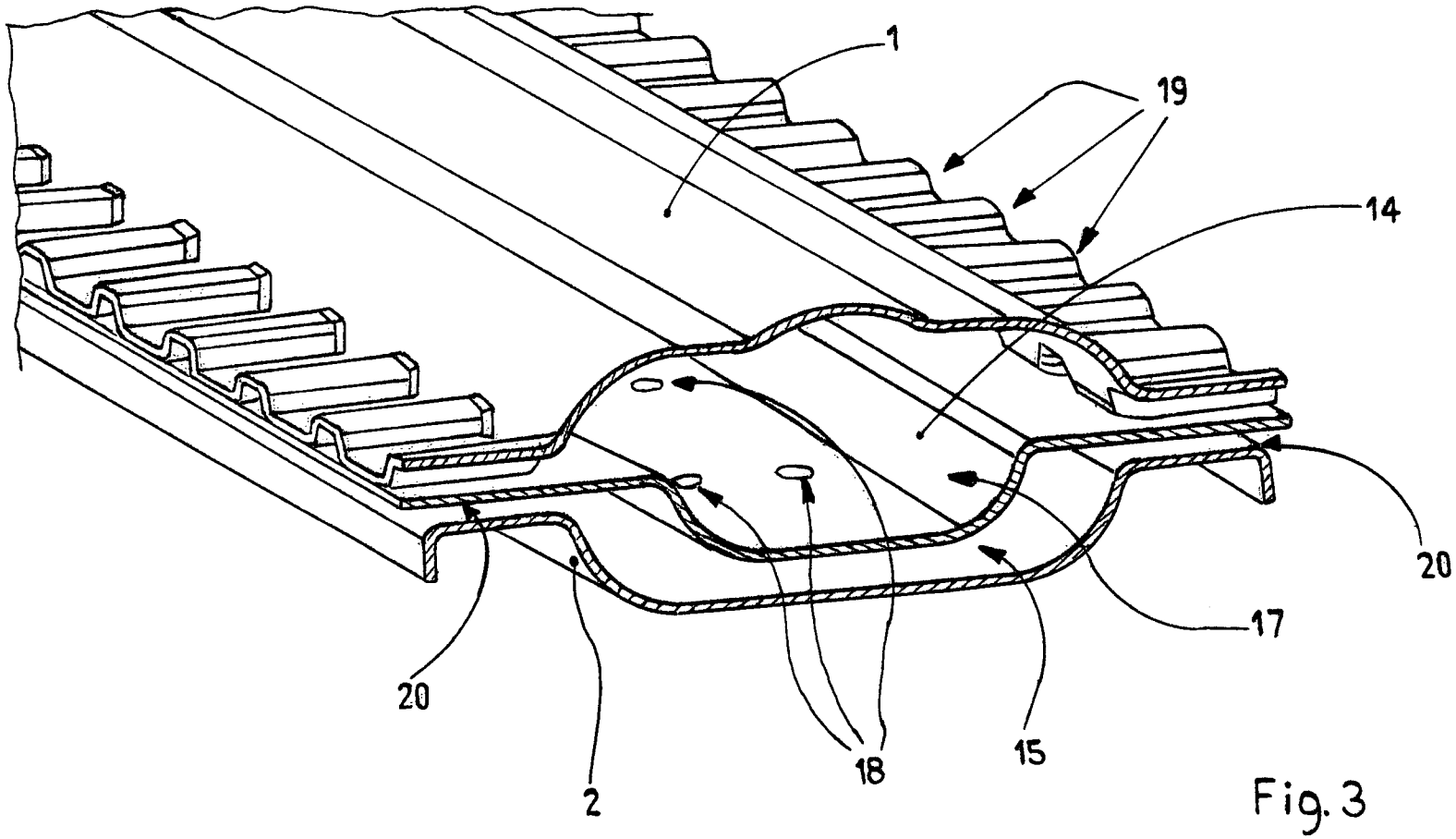
FIG. 3 is a prospective view of the crossing section of the burner.

FIGS. 2 and 3 explain more in detail the inner shape of the herein described burner, and particularly they show some constructive details that, in addition to the afore said diversion duct 12, will contribute to grow up the effectiveness and efficiency of such a burner.

In FIG. 2 it can be seen the burner of FIG. 1 attached to an oven wall 22, by a bracket 24, that—constituting the afore said means for coupling the burner to the oven wall 22—is constrained at the back to such a wall 22 and comprises an ejection nozzle (or injector) 23 of the fuel gas, connected by an proper clutch to the distribution duct of the same fuel gas, an housing 31 for clutching the burner at the inlet section 11 of the Venturi tube 16, as well at least one seat 25 (as will be more detailed referring to FIG. 4) for an ignition spark plug of the fuel mixture and a seat 26 for a thermocouple belonging to a safety device (not illustrated).

FIGS. 2 and 3 further show more in detail the inner burner structure, providing the interposition of an intermediate plate 14 between the two upper 1 and lower 2 semi-shells, mutually coupled, the plate forming with the upper semi-shell 1 the afore said Venturi tube 16 and further, upstream the diverging section of such a Venturi tube 16, splitting the chamber downstream the Venturi tube 16 itself in an upper distribution chamber 17 of the mixture to the flame openings 19, and in a lower storage chamber 15 for mixture, having the function of flame stabilization. Such two chambers 17, 15, mutually overlapping, are reciprocally in fluidic communication thanks to the holes 18 obtained in the intermediate plate 14, downstream the Venturi tube 16.

Whereas the upper distribution chamber 17 for the fuel mixture is, as afore said, in fluidic communication with the flame openings 19, formed by little ducts having practically a quadrangular section, the lower chamber 15 communicates too, at every sides, with a longitudinal calibrated passageway 20, having substantially the function of allowing the flame propagation from the ignition hole 13 to the overhanging flame openings 19.

Such a calibrated passageways 20 are obtained between the lower semi-shell 2 and the lower wall of the intermediate plate 14, thanks to the spacers present between such parts, or thanks to the particular semi-shell 2 shape and the intermediate plate 14, whereas the flame openings 19, having essentially a quadrangular section, particularly visible in FIG. 3, are realized between the upper wall of the intermediate plate 14 and the upper semi-shell 1, by moulding the upper semi-shell 1 itself along the main extending sides thereof, in the zone downstream the diverging section of the Venturi tube 16.

It has to be observed that the flame openings 19 are not simply holes over the outer surface of the burner, although the possible hole execution falls in the inventive conception of the present invention, but small ducts having a development in a normal direction relative to the burner height, having the object to stabilize the flame and avoid its detachment.

Finally, it has to be further observed that, although visible in FIG. 1 only, the burner ending opposite that wherein the Venturi tube 16 is present, is truncated in such a way that the two semi-shells 1, 2 would exhibit a moderate reciprocal convergence, with the object to aid continuity in the mixture flow.

Figure 4:
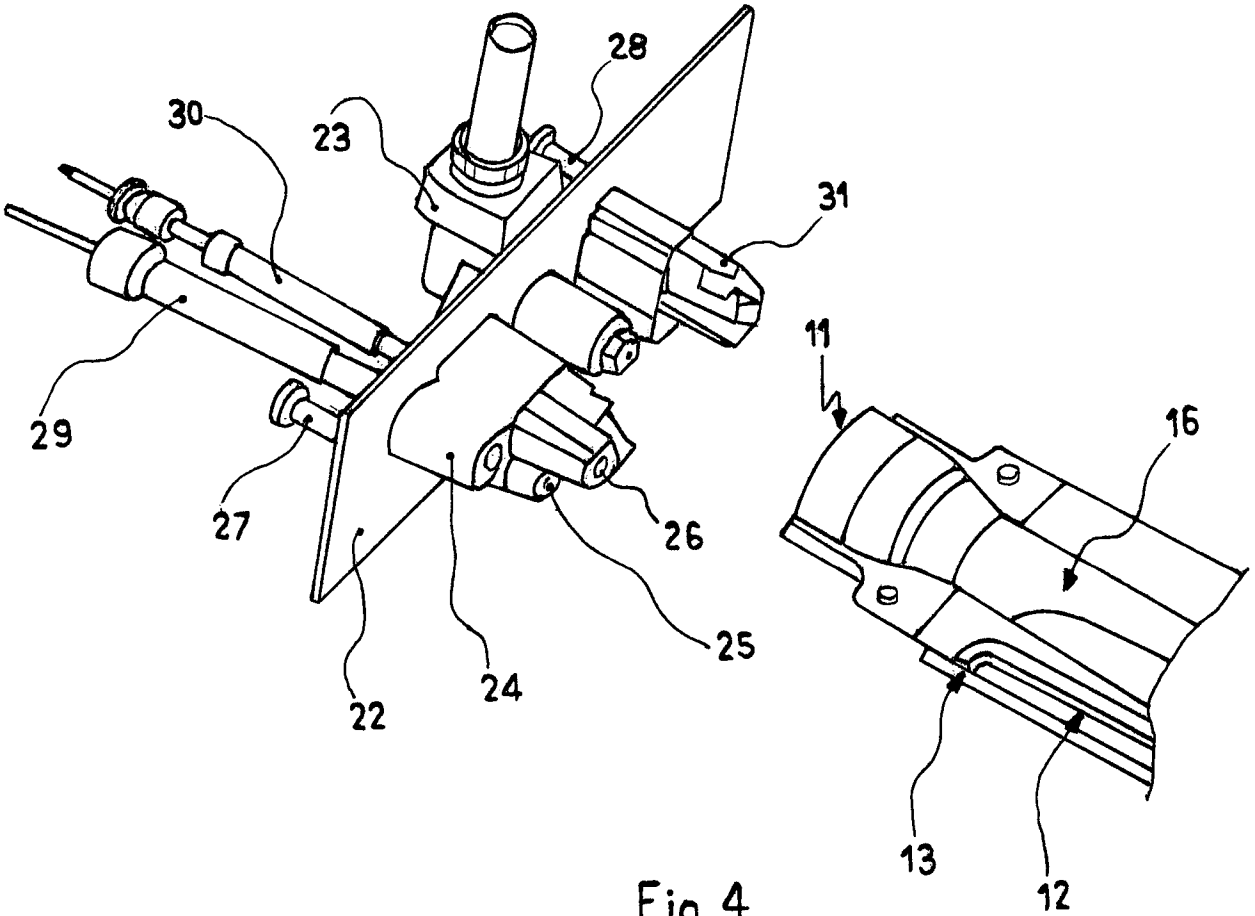
FIG. 4 is a prospective view of the mounting bracket.

FIG. 4 illustrates in detail the means for coupling the afore illustrated burner to an oven wall 22, according to a particular aspect of the present invention, particularly composed of a shaped bracket 24 constrained at the back to the oven wall 22, by the screws 27 and 28, engaging in the complementary seats realized on the same wall 22 of the oven.

Such a wall 22 further presents holes and openings allowing the bracket itself 24, and particularly the various functional elements thereof, to extend over the front face of the same wall 22, into the oven cavity.

The bracket 24 herein illustrated, according to another aspect of the present invention, is realized in only one metallic block on which the functional elements for the burner clutching engagement are disposed, such as a main duct for the gas ending into the gas injector 23, two seats 25 and 26 for housing the ignition spark plug 29 and the thermocouple 30 of the burner safety device (the spark plug 29 and the thermocouple 30 are illustrated not fitted into the bracket 24, in FIG. 4), and a housing 31 for clutching the burner at the inlet section 11 thereof of the Venturi tube 16.

The housing 31, as visible in FIG. 4, is shaped in such a way to accommodate, for example by mechanical interference of parts, some outer complementary regions of the burner, for example composed of shaped fins, forming part of the coupling means of the burner to the wall oven 22, together with the afore said bracket 24.

It has to be observed that such a bracket 24 allows, thanks to the fact that the diversion duct 12 allows to dispose the ignition hole 13 in proximity of the afore said inlet section 11, and then in proximity of the oven wall 22, to hold both the ignition spark plug 29, and the thermocouple 30 in proximity of, or at the oven wall 22 itself, and even to constrain them in contact with the latter; such that both the ignition spark plug 29, and the thermocouple 30 might protrude only partially into the oven cavity, although being disposed in an optimal way at the ignition hole 13 and the flame openings 19, respectively.

This arrangement allows not only to avoid the elongated bracket use within the cavity oven that, because of the possible thermic deformations when the oven is switched on, might cause misalignments of the ignition spark plug relative to the ignition hole and of the thermocouple relative to the flame holes, but also to prevent that the wirings of such an electric components would house at least partially within the cavity oven, demanding a substantial heat-insulation thereof.

Further, as can be seen in detail in FIG. 4, advantageously the oven wall 22 is conveniently pierced at the bracket 24 seats for the ignition spark plug 29 and the thermocouple 30, such that the insertion of the latter into the bracket 24 might be performed from the back side of the oven wall 22, that is from the outer side of the oven cavity itself. In such a way, possible removal and insertion operations of the ignition spark plug 29 and the thermocouple 30, caused for example by maintenance, are markedly facilitated.

Mounting and operation of the afore described burner are as follows. First the burner is composed by coupling, thanks to the clamping means 3, 4, 5, 6, 7, 8, 9, 10, the two semi-shells 1, 2, with the intermediate plate 14 interposition.

Then, once the bracket 24 is fixed by the screws 27, 28 to the back face of the oven wall 22, and being executed the injector 23 connection to the domestic fuel gas-distribution system, the burner, thus properly assembled, is inserted, at the afore said inlet section 11 of the fuel gas, into the housing 31 of the bracket 24; the housing being protruding, thanks to the holes conveniently realized into the oven wall 22, within the cavity of the latter.

At this point, the insertion to partial protrusion into the oven cavity itself of the ignition spark plug 29 and the thermocouple 30, respectively at the ignition hole 13 and at one or more flame openings 19, would complete the afore illustrated burner assembling within the oven. It has to be observed that the wirings of the ignition spark plug 29 and of the thermocouple 30 thereby could be completely situated outside the oven cavity.

Once the fuel gas passing through the injector 23 is activated, by the user by means of an proper tap, the gas would pass through the Venturi tube 16 and causes, for the Venturi effect (because of the tube 16 shape) a depression at the zone with reduced section of the Venturi tube 16 itself, drawing air (primary air) from the environment outside the burner into such a Venturi tube.

In the zone with a diverging section situated downstream such a zone with a reduced section of the Venturi tube the mixing completion between primary air and fuel gas is obtained, and the fuel gas-primary air mixture so produced is partially broached from the diversion duct 12, which inlet section—preferably made of an opening obtained on the inner wall of the Venturi tube 16 or the distribution chamber 17—is placed in proximity, or downstream, of the zone with a diverging section of the Venturi tube 16, and partially will continue into the distribution chamber 17 and, thanks to the holes 18 of the intermediate plate 14, into the storage chamber 15. The fuel mixture then starts flowing out from the ignition hole 13, from the calibrated passageway 20 and the flame openings 19, respectively situated in fluidic communication with the diversion duct 12, with the storage chamber 15 and the distribution chamber 17.

At this time, the activation (ignition) of the ignition spark plug 29 by the user, usually coinciding with the manual exclusion of the safety device associated with the thermocouple 30, causes the ignition of a starting flame exiting the hole 13, and its propagation, thanks to the calibrated passageway 20, to all the flame openings 19 of the burner, with a consequent ignition of the latter.

As will be evident for a person skilled in the art, the secure position of the ignition hole 13, preferably next the oven wall, has the considerable advantage of being able to mount the ignition spark plug, and eventually the thermocouple, completely or at least partially, on the outside of the oven, moving close the corresponding ending part to the ignition hole only.

It is therefore avoided the use of bracket adapted to support the ignition spark plug, or the thermocouple, within the oven, as well it is assured the insulated wiring removal, these being rested outside the oven cavity.

The overheating of the ignition spark plug itself is limited too, being exiguous the percentage thereof elongated inside the oven, thereby improving the performance and life.

At least, possible removal and inserting operations of the ignition spark plug 29 and the thermocouple 30 for maintenance, are remarkably facilitated.

The invention claimed is:

1. A burner for an oven or grill, comprising:

at least one Venturi tube for forming a fuel mixture of primary air-gas, having at least one zone with a reduced section followed by a zone with a diverging section;

at least one distribution chamber of the fuel mixture, placed downstream of said at least one zone with a diverging section of the Venturi tube;

a plurality of flame openings for an outflow of said fuel mixture, obtained within said distribution chamber or in fluidic communication with the distribution chamber; and at least one ignition hole for igniting the burner, comprising at least one diversion duct for part of a flow of said fuel mixture, an inlet section of said diversion duct being obtained in a sector downstream from said zone with a reduced section of the Venturi tube and an outlet section of said diversion duct being placed at said at least one ignition hole, wherein the diversion duct is placed upstream of the flame openings;

wherein the at least one distribution chamber further comprises:

an upper distribution chamber of the fuel mixture, the upper distribution chamber being in fluidic communication with the flame openings; and a lower storage chamber for the fuel mixture, the lower storage chamber being located under the upper distribution chamber, the lower storage chamber communicating with a longitudinal calibrated passageway extending below the flame openings for propagating a flame from the at least one ignition hole to the plurality of flame openings.

2. The burner according to claim 1, wherein said at least one ignition hole is disposed on the burner in proximity to at least one oven or grill wall.

3. The burner according to claim 1, wherein said burner comprises a bracket for coupling to at least one oven or grill wall, said at least one ignition hole being disposed on the burner in proximity to said bracket.

4. The burner according to claim 3, wherein said bracket is disposed at an inlet section of said at least one Venturi tube.

5. The burner according to claim 1, wherein said inlet section of said diversion duct comprises at least one opening located on one of an inner wall of said at least one Venturi tube an inner wall of said at least one distribution chamber.

6. The burner according to claim 1, wherein said at least one Venturi tube is of axial type.

7. The burner according to claim 1, wherein the inlet section of said at least one diversion duct is placed downstream of said zone with a diverging section of said at least one Venturi tube.

8. The burner according to claim 1, further comprising one or more ignition holes to ignite the burner, said one or more ignition holes being exclusively coincident with the outlet section of said at least one diversion duct.

9. The burner according to claim 1, wherein said diversion duct is disposed in a burner body by moulding or the diversion duct comprises an outer duct attached to the burner.

10. The burner according to claim 1, wherein said at least one diversion duct is oriented to carry said part of the mixture flow in a co-current or countercurrent way relative to the mixture flow in said distribution chamber.

11. An oven comprising:

a bracket for coupling directly or indirectly, to a wall of said oven, or grill, of a gas burner according to claim 1; and an ignition spark plug for said at least one gas burner, wherein said at least one ignition spark plug is disposed in proximity to, or at said oven or grill wall.

12. The oven according to claim 11, wherein said at least one ignition spark plug is in contact with said oven or grill wall.

13. The oven according to claim 11, wherein said bracket comprises at least one seat for said ignition spark plug.

14. The oven according to claim 11, wherein said bracket comprises at least one seat for at least one thermocouple.

15. The oven according to claim 11 comprising one of an ignition spark plug and a thermocouple partially protruding from said oven or grill wall.

16. The burner according to claim 1, further comprising a storage chamber disposed underneath the distribution chamber, the distribution chamber and the storage chamber being in fluid communication.

17. The burner according to claim 16, wherein the storage chamber allows flame propagation from the ignition hole to the flame openings.

18. The burner according to claim 1, wherein the burner is provided with only one ignition hole exclusively coincident with the outlet section of the diversion duct.

19. The burner according to claim 1, wherein the flame openings have a substantially quadrangular section.

* * * * *